US011549511B2

(12) United States Patent
Jo

(10) Patent No.: US 11,549,511 B2
(45) Date of Patent: Jan. 10, 2023

(54) SCROLL COMPRESSOR

(71) Applicant: LG ELECTRONICS INC., Seoul (KR)

(72) Inventor: Changeol Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 95 days.

(21) Appl. No.: 16/953,635

(22) Filed: Nov. 20, 2020

(65) Prior Publication Data

US 2021/0396228 A1 Dec. 23, 2021

(30) Foreign Application Priority Data

Jun. 17, 2020 (KR) ..... 10-2020-0073804

(51) Int. Cl.
*F04C 18/02* (2006.01)
*F04C 29/02* (2006.01)

(52) U.S. Cl.
CPC ..... *F04C 18/0215* (2013.01); *F04C 18/0253* (2013.01); *F04C 18/0261* (2013.01); *F04C 2240/30* (2013.01); *F04C 2240/806* (2013.01)

(58) Field of Classification Search
CPC ..... F04C 18/0215; F04C 18/0253; F04C 18/0261; F04C 29/12
See application file for complete search history.

(56) References Cited

U.S. PATENT DOCUMENTS 6,457,948 B1 * 10/2002 Pham ..... F04C 27/005 417/310
8,152,503 B2 * 4/2012 Haller ..... F04C 18/0215 418/55.5
2006/0222545 A1 * 10/2006 Nam ..... F04C 18/0253 418/55.1
2013/0064703 A1 * 3/2013 Park ..... F04C 27/008 418/55.4
2019/0041107 A1 2/2019 Piscopo et al.

FOREIGN PATENT DOCUMENTS

JP 2006-283753 10/2006
KR 10-2015-0126499 11/2015

OTHER PUBLICATIONS

Korean Office Action issued in Application No. 10-2020-0073804 dated Aug. 4, 2021.

* cited by examiner

*Primary Examiner* — Deming Wan
(74) *Attorney, Agent, or Firm* — KED & Associates, LLP

(57) ABSTRACT

A scroll compressor may include a casing having a low pressure portion and a high pressure portion, a refrigerant suction pipe that communicates with the low pressure portion and a refrigerant discharge pipe that communicates with the high pressure portion, a drive motor installed inside of the low pressure portion, an orbiting scroll coupled to the drive motor to perform an orbiting motion, a non-orbiting scroll engaged with the orbiting scroll to form a compression chamber, and a refrigerant guide provided on the non-orbiting scroll to guide a refrigerant suctioned into the low pressure portion to be suctioned into the compression chamber, whereby an increase in specific volume of refrigerant suctioned into the compression chamber may be suppressed, and thus, an amount of refrigerant suctioned into the compression chamber may increase, thereby improving efficiency of the compressor.

19 Claims, 11 Drawing Sheets

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2020-0073804, filed in Korea on Jun. 17, 2020, the contents of which is incorporated by reference herein in its entirety.

BACKGROUND

1. Field

A scroll compressor is disclosed herein.

2. Background

A scroll compressor is configured such that an orbiting scroll and a non-orbiting scroll are engaged with each other and a pair of compression chambers is formed while the orbiting scroll performs an orbiting motion with respect to the non-orbiting scroll. The pair of compression chambers includes a suction pressure chamber formed at an outer side, an intermediate pressure chamber continuously formed toward a central portion from the suction pressure chamber while gradually decreasing in volume, and a discharge pressure chamber connected to a center of the intermediate pressure chamber. Typically, the suction pressure chamber is formed through a side surface of a non-orbiting scroll, the intermediate pressure chamber is sealed, and the discharge pressure chamber is formed through an end plate of the non-orbiting scroll.

Scroll compressors may be classified into a low-pressure type and a high-pressure type according to a path through which refrigerant is suctioned. The low-pressure type is configured such that a refrigerant suction pipe is connected to an inner space of a casing to guide suctioned refrigerant at a low temperature to flow into a suction pressure chamber via an inner space of a casing. On the other hand, the high-pressure type is configured such that a refrigerant suction pipe is connected directly to the suction pressure chamber to guide refrigerant to flow directly into the suction pressure chamber without passing through the inner space of the casing.

The low-pressure type has an advantage of improving efficiency of the compressor as a portion of the suctioned refrigerant cools a drive motor while passing through the inner space of the casing. However, as a temperature of the suctioned refrigerant brought into contact with the drive motor increases, a specific volume in the suction pressure chamber increases, thereby causing suction loss. Further, in the low-pressure type, the specific volume is further increased as even suctioned refrigerant that is not brought into contact with the drive motor comes into contact with a high/low pressure separation plate or is heated by radiant heat, which may cause the suction loss to be further increased.

BRIEF DESCRIPTION OF THE DRAWINGS

Embodiments will be described in detail with reference to the following drawings in which like reference numerals refer to like elements, and wherein.

DETAILED DESCRIPTION

Figure 1:
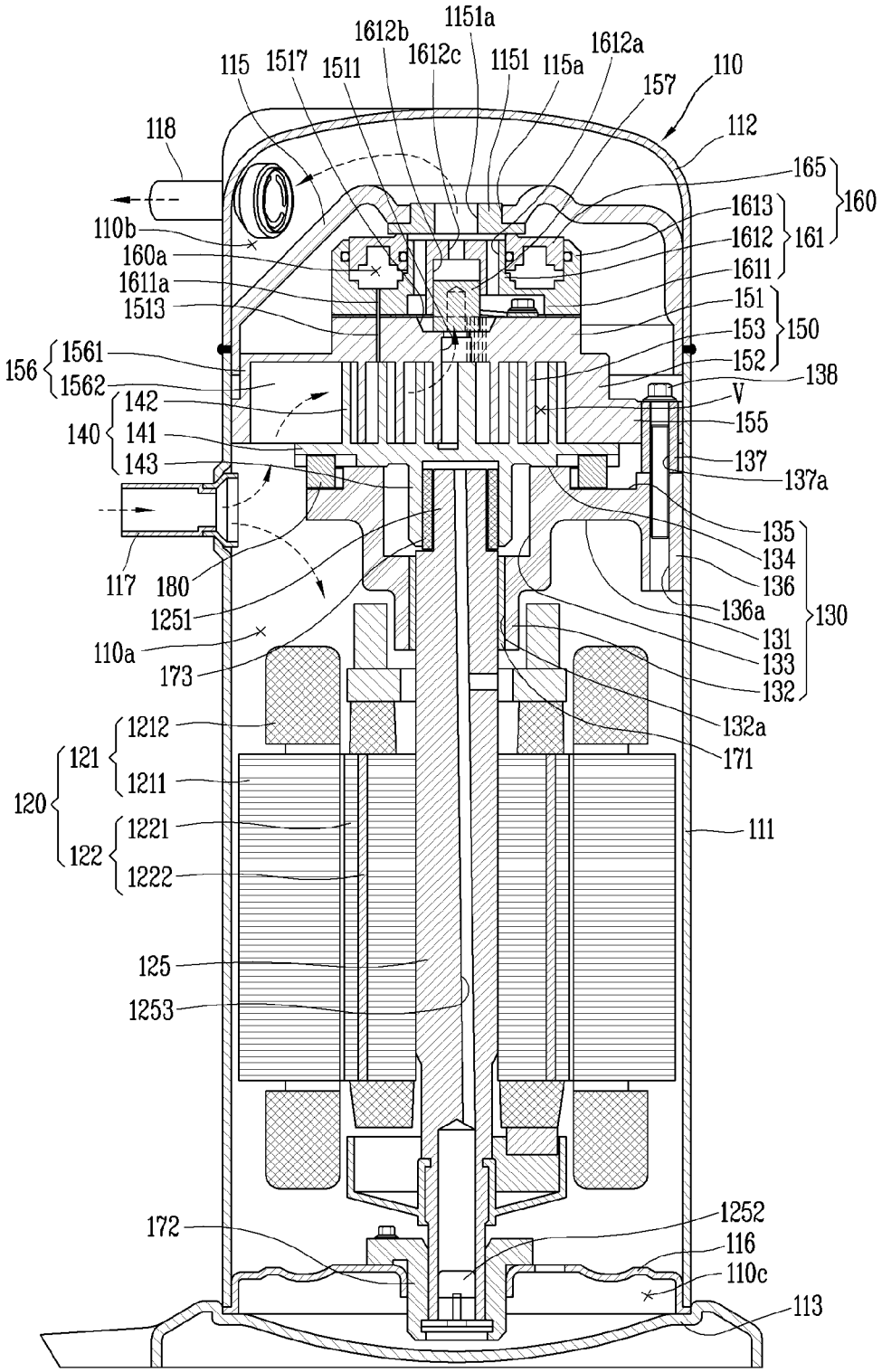
FIG. 1 is a longitudinal cross-sectional view illustrating inner structure of a capacity-variable scroll compressor in accordance with an embodiment.

Description will now be given of a scroll compressor according to embodiments disclosed herein, with reference to the accompanying drawings. Where possible, like reference numerals have been used to indicate like elements, and repetitive disclosure has been omitted.

Figure 2:
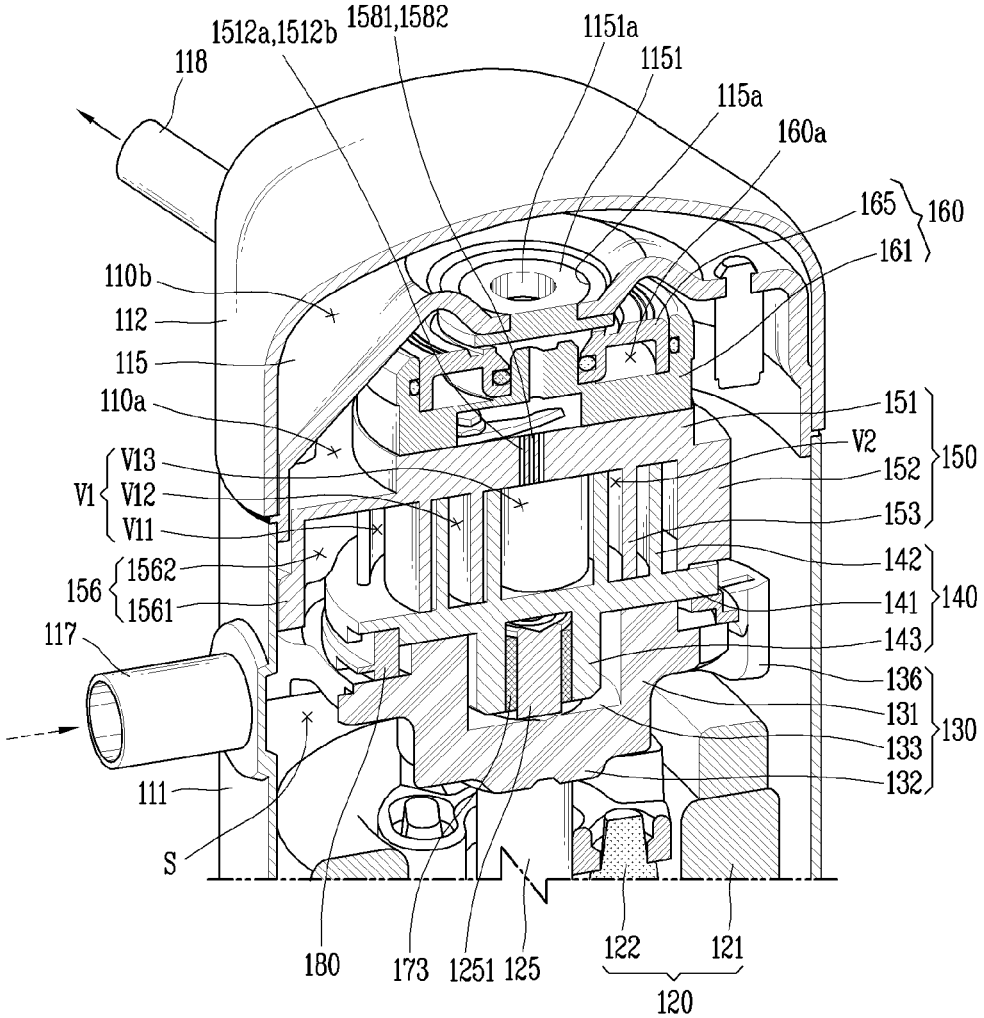
FIG. 2 is a partial cross-sectional perspective view illustrating the inner structure of the scroll compressor of FIG. 1.
Figure 3:
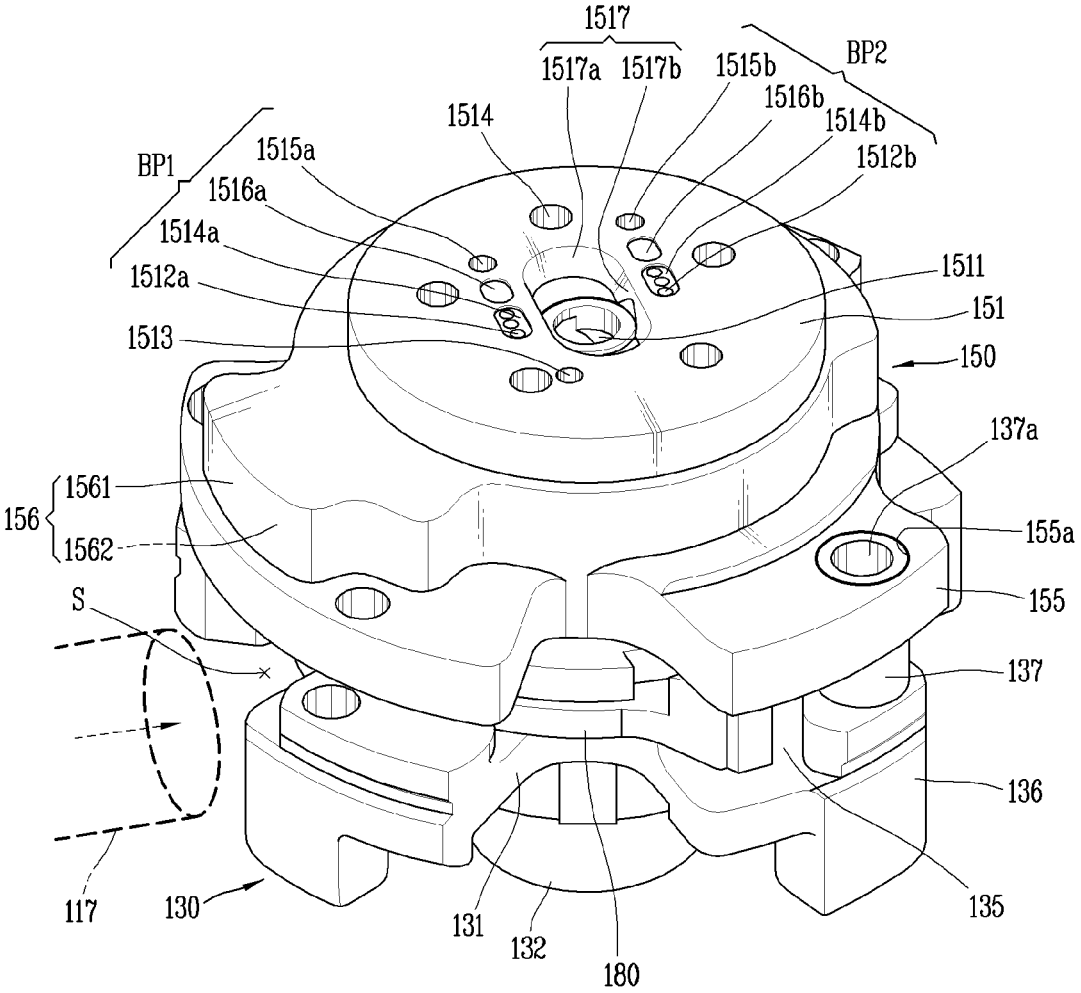
FIG. 3 is an assembled perspective view illustrating a compression unit of the scroll compressor of FIG. 2.

FIG. 1 is a longitudinal cross-sectional view illustrating an inner structure of a capacity-variable scroll compressor in accordance with an embodiment, FIG. 2 is a partial cross-sectional perspective view illustrating the inner structure of the scroll compressor of FIG. 1. FIG. 3 is an assembled perspective view illustrating a compression unit of the scroll compressor of FIG. 2.

As illustrated in FIGS. 1 and 2, in a scroll compressor according to an embodiment, a drive motor 120 may be installed in a lower half portion of the casing 110, and a main frame 130, an orbiting scroll 140, a non-orbiting scroll 150, and a back pressure chamber assembly 160 may be sequentially disposed above the drive motor 120. In general, the drive motor 120 may constitute a motor unit or motor, and the main frame 130, the orbiting scroll 140, the non-orbiting scroll 150, and the back pressure chamber assembly 160 may constitute a compression unit. The motor unit may be coupled to one or a first end of a rotational shaft 125, and the compression unit may be coupled to another end of the rotational shaft 125. Accordingly, the compression unit may be connected to the motor unit by the rotational shaft 125 to be operated by a rotational force of the motor unit.

The casing 110 may include a cylindrical shell 111, an upper cap 112, and a lower cap 113. The cylindrical shell 111 may have a cylindrical shape with upper and lower ends open, and the drive motor 120 and the main frame 130 may be fitted on an inner circumferential surface of the cylindrical shell 111 in an inserting manner. A terminal bracket (not shown) may be coupled to an upper portion of the cylindrical shell 111, and a terminal (not shown) that transmits external power to the drive motor 120 may be coupled through the terminal bracket. In addition, a refrigerant suction pipe 117, described hereinafter, may be coupled to the upper portion of the cylindrical shell 111, for example, above the drive motor 120.

The upper cap 112 may be coupled to cover the open upper end of the cylindrical shell 111, and the lower cap 113 may be coupled to cover the open lower end of the cylindrical shell 111. An edge (rim) of a high/low pressure separation plate 115, described hereinafter, may be inserted between the cylindrical shell 111 and the upper cap 112 and coupled, for example, welded, to the cylindrical shell 111 and the upper cap 112, and an edge of a support bracket 116, described hereinafter, may be inserted between the cylindrical shell 111 and the lower cap 113 and coupled, for example, welded to the cylindrical shell 111 and the lower cap 113. Accordingly, the inner space of the casing 110 may be sealed.

An edge of the high/low pressure separation plate 115, as described above, may be coupled, for example, welded to the casing 110 and a central portion of the high/low pressure separation plate 115 may be bent to protrude toward the upper cap 112 so as to be disposed above the back pressure chamber assembly 160. The refrigerant suction pipe 117 may communicate with a space below the high/low pressure separation plate 115, and a refrigerant discharge pipe 118 may communicate with a space above the high/low separation plate 115. Accordingly, a low pressure portion 110*a* constituting a suction space may be formed below the high/low pressure separation plate 115, and a high pressure portion 110*b* constituting a discharge space may be formed above the high/low pressure separation plate 115.

In addition, a through hole 115*a* may be formed through a center of the high/low pressure separation plate 115, and a sealing plate 1151 to which a floating plate 165, described hereinafter, may be detachably coupled may be inserted into the through hole 115*a*. Accordingly, the low pressure portion 110*a* and the high pressure portion 110*b* may be blocked from or communicate with each other by the floating plate 165 and the sealing plate 1151.

The sealing plate 1151 may be formed in an annular shape. For example, a high-low pressure communication hole 1151*a* may be formed through a center of the sealing plate 1151 so that the low pressure portion 110*a* and the high pressure portion 110*b* communicate with each other. The floating plate 165 may be attachable and detachable along a circumference of the high/low pressure communication hole 1151*a*. Accordingly, the floating plate 165 may be attached to or detached from a circumference of the high/low pressure communication hole 1151*a* of the sealing plate 1151 while moving up and down by back pressure in an axial direction. During this process, the low pressure portion 110*a* and the high pressure portion 110*b* may be sealed from each other or communicate with each other.

In addition, the lower cap 113 may define an oil storage space 110*c* together with a lower portion of the cylindrical shell 111 constituting the low pressure portion 110*a*. In other words, the oil storage space 110*c* may be defined in the lower portion of the low pressure portion 110*a*. The oil storage space 110*c* may define a portion of the low pressure portion 110*a*.

Hereinafter, the drive motor will be described.

Referring to FIG. 1, the drive motor 120 according to an embodiment may be disposed in the lower portion of the low pressure portion 110*a* and include a stator 121 and a rotor 122. The stator 121 may be, for example, shrink-fitted to an inner wall surface of the casing 111, and the rotor 122 may be rotatably provided inside of the stator 121.

The stator 121 may include a stator core 1211 and a stator coil 1212. The stator core 1211 may be formed in a cylindrical shape and may be, for example, shrink-fitted to an inner circumferential surface of the cylindrical shell 111. The stator coil 1212 may be wound around the stator core 1211 and may be electrically connected to an external power source through a terminal (not shown) that is coupled through the casing 110.

The rotor 122 may include a rotor core 1221 and permanent magnets 1222. The rotor core 1221 may be formed in a cylindrical shape, and may be rotatably inserted into the stator core 1211 at intervals of predetermined gaps. The permanent magnets 1222 may be embedded in the rotor core 1222 at preset or predetermined intervals along a circumferential direction.

The rotational shaft 125 may be coupled to a center of the rotor 122. An upper end portion or end of the rotational shaft 125 may be rotatably inserted into the main frame 130, described hereinafter, so as to be supported in a radial direction, and a lower end portion or end of the rotational shaft 125 may be rotatably inserted into a support bracket 116 to be supported in the radial and axial directions. The main frame 130 may be provided with a main bearing 171 that supports the upper end portion of the rotational shaft 125, and the support bracket 116 may be provided with a sub bearing 172 that supports the lower end portion of the rotational shaft 125. The main bearing 171 and the sub bearing 172 each may be configured as a bush bearing.

An eccentric portion 1251 that is eccentrically coupled to the orbiting scroll 140, described hereinafter, may be formed on the upper end portion of the rotational shaft 125, and an oil feeder 1252 that absorbs oil stored in a lower portion of the casing 110 may be disposed in the lower end portion of the rotational shaft 125. An oil supply passage 1253 may be formed through the rotational shaft 125 in the axial direction.

Hereinafter, the main frame will be described.

The main frame 130 according to an embodiment may be disposed above the drive motor 120 and may be, for example, shrink-fitted or welded to an inner wall surface of the cylindrical shell 111. Referring to FIGS. 1 to 3, the main frame 130 may include a main flange portion or flange 131, a main bearing portion 132, an orbiting space portion or space 133, a scroll support portion or support 134, an Oldham ring accommodation portion 135, and a frame fixing portion 136.

The main flange 131 may be formed in an annular shape and accommodated in the low pressure portion 110*a* of the casing 110. An outer diameter of the main flange 131 may be smaller than an inner diameter of the cylindrical shell 111 so that an outer circumferential surface of the main flange 131 is spaced apart from an inner circumferential surface of the cylindrical shell 111. However, the frame fixing portion 136, described hereinafter, may protrude from the outer circumferential surface of the main flange 131 in the radial direction, and an outer circumferential surface of the frame fixing portion 136 may be brought into close contact with and fixed to the inner circumferential surface of the casing 110. Accordingly, the frame 130 may be fixedly coupled to the casing 110.

The main bearing portion 132 may protrude downward from a lower surface of a central portion of the main flange 131 toward the drive motor 120. The main bearing portion 132 may be provided with a bearing hole 132*a* formed therethrough in a cylindrical shape along the axial direction, and the main bearing 171 configured as the bush bearing may be fixedly coupled to an inner circumferential surface of the bearing hole 132 in an inserted manner. The rotational shaft 125 may be inserted into the main bearing 171 to be supported in the radial direction.

The orbiting space 133 may recessed from the center portion of the main flange 131 toward the main bearing portion 132 by preset or predetermined depth and outer diameter. The orbiting space 133 may be larger than an outer diameter of a rotational shaft coupling portion 143 provided on the orbiting scroll 140, described hereinafter. Accordingly, the rotational shaft coupling portion 143 may be pivotally accommodated in the orbiting space 133.

The scroll support 134 may be formed in an annular shape on an upper surface of the main flange 131 along a periphery of the orbiting space 133. Accordingly, the scroll support 134 may support a lower surface of an orbiting end plate 141, described hereinafter, in the axial direction.

The Oldham ring accommodation portion 135 may be formed in an annular shape on an upper surface of the main flange 131 along an outer circumferential surface of the scroll support 134. Accordingly, an Oldham ring 180 may be inserted into the Oldham ring accommodation portion 135 to perform an orbiting motion.

The frame fixing portion 136 may extend radially from an outer surface of the Oldham ring accommodation portion 135. The frame fixing portion 136 may extend in an annular shape or may extend to form a plurality of protrusions spaced apart from one another by preset or predetermined intervals. Embodiments illustrate an example in which the frame fixing portion 136 is configured as a plurality of protrusions along the circumferential direction.

For example, a plurality of the frame fixing portion 136 may be provided, disposed at preset or predetermined intervals along the circumferential direction. The plurality of frame fixing portions 136 may be provided with bolt coupling holes 136*a*, respectively, which are formed therethrough in the axial direction. The plurality of frame fixing portions 136 may be formed to correspond to respective guide protrusions 155 of the non-orbiting scroll 150, described hereinafter, in the axial direction, and the bolt coupling holes 136*a* may be formed to correspond to respective guide insertion holes 155*a*, described hereinafter, in the axial direction.

An inner diameter of each bolt coupling hole 136*a* may be smaller than an inner diameter of the guide insertion hole 155*a*. Accordingly, a stepped surface extending from an inner circumferential surface of the guide insertion hole 155*a* may be formed around an upper surface of the bolt coupling hole 136*a*, and a guide bush 137 that is inserted through the guide insertion hole 155*a* may be placed on the stepped surface so as to be supported on the frame fixing portion 136 in the axial direction.

The guide bush 137 may be formed in a hollow cylindrical shape through which the bolt insertion hole 137*a* is formed in the axial direction. Accordingly, a guide bolt 138 may be inserted through the bolt insertion hole 137*a* of the guide bush 137 to be coupled to the bolt coupling hole 136*a* of the frame fixing portion 136. The non-orbiting scroll 150 may thus be slidably supported on the main frame 130 in the axial direction and fixed to the main frame 130 in the radial direction.

As described above, as the frame fixing portions 136 are formed at the preset intervals along the circumferential direction, a kind of suction guide space S may be defined between the adjacent frame fixing portions 136. Accordingly, a refrigerant suctioned into the low pressure portion 110*a* may be guided to a suction guide passage 1562 of the non-orbiting scroll 150, described hereinafter, through the suction guide space S between the adjacent frame fixing portions 136. Accordingly, when viewed in the axial direction, the refrigerant suction pipe 117 and the suction guide passage 1562 may be formed within a range of the suction guide space S to reduce flow resistance. This will be described hereinafter, together with the suction guide passage 1562.

Hereinafter, the orbiting scroll will be described.

The orbiting scroll 140 according to embodiments may be disposed on an upper surface of the main frame 130. The Oldham ring 180, which is an anti-rotation mechanism, may be provided between the orbiting scroll 140 and the main frame 130 or between the orbiting scroll 140 and the non-orbiting scroll 150, described hereinafter, so as to perform an orbiting motion.

Referring to FIGS. 1 and 2, the orbiting scroll 140 according to the implementation may include the orbiting end plate 141, an orbiting wrap 142, and the rotational shaft coupling portion 143. The orbiting end plate 141 may be formed substantially in a disk shape. An outer diameter of the orbiting end plate 141 may be larger than or equal to an inner diameter of a passage inlet portion or inlet 1562*a* (see FIG. 5) defining a part or portion of the suction guide passage 1562, described hereinafter, and smaller than an outer diameter of the passage inlet 1562*a*. Accordingly, the passage inlet 1562*a* of the suction guide passage 1562 may always be kept open even if the orbiting end plate 141 performs an orbiting motion.

The inner diameter of the passage inlet 1562*a* may be defined as a diameter for a virtual line that extends between inner wall surfaces of the passage inlet 1562*a* (more specifically, a passage outlet), and the outer diameter of the passage inlet 1562*a* may be defined as a diameter for a virtual line that extends between outer wall surfaces of the passage inlet 1562*a*. It will be described hereinafter together with the suction guide passage.

The orbiting wrap 142 may be formed in a spiral shape by protruding from an upper surface of the orbiting end plate 141 facing the non-orbiting scroll 150 up to a preset or predetermined height. The orbiting wrap 142 may correspond to a non-orbiting wrap 153 to perform an orbiting motion by being engaged with the non-orbiting wrap 153 of the non-orbiting scroll 150 described hereinafter. The orbiting wrap 142 may define a compression chamber V together with the non-orbiting wrap 153.

The compression chamber V may include a first compression chamber V1 and a second compression chamber V2 based on the non-orbiting wrap 153 described hereinafter. The first compression chamber V1 may be formed at an outer surface of the non-orbiting wrap 153, and the second compression chamber V2 may be formed at an inner surface of the non-orbiting wrap 153. Each of the first compression chamber V1 and the second compression chamber V2 may include a suction pressure chamber V11, an intermediate pressure chamber V12, and a discharge pressure chamber V13 that are continuously formed.

The rotational shaft coupling portion 143 may protrude from a lower surface of the orbiting end plate 141 toward the main frame 130. The rotational shaft coupling portion 143 may be formed in a cylindrical shape, and an eccentric portion bearing 173 may be coupled to an inner circumferential surface of the rotational shaft coupling portion 143 in an inserted manner. The eccentric portion bearing 173 may be configured as a bush bearing.

A length of the rotational shaft coupling portion 143 may be shorter than a depth of the orbiting space 135, and an outer diameter of the rotational shaft coupling portion 143 may be smaller than an inner diameter of the orbiting space 135 by at least twice of an orbiting radius. Accordingly, the rotational shaft coupling portion 143 may perform the orbiting motion while being accommodated in the orbiting space 135.

The Oldham ring 180 may be provided between the main frame 130 and the orbiting scroll 140 to restrict a rotational motion of the orbiting scroll 140. As described above, the Oldham ring 180 may be slidably coupled to the main frame 130 and the orbiting scroll 140, respectively, or slidably coupled to the orbiting scroll 140 and the non-orbiting scroll 150, respectively.

Hereinafter, the non-orbiting scroll will be described.

The non-orbiting scroll 150 according to embodiments may be disposed above the orbiting scroll 140. The non-orbiting scroll 150 may be fixedly coupled to the main frame 130, or may be coupled to the main frame 130 to be movable up and down. The embodiments illustrate an example in which the non-orbiting scroll 150 is coupled to the main frame 130 to be movable relative to the main frame 130 in the axial direction.

Referring to FIGS. 1 to 3, the non-orbiting scroll 150 according to embodiments may include a non-orbiting end plate 151, a non-orbiting side wall portion 152, and a non-orbiting wrap 153. The non-orbiting end plate 151 may be formed in a disk shape and disposed in a horizontal direction in the low pressure portion 110*a* of the casing 110. A discharge port 1511, a bypass hole 1512, and a scroll-side back pressure hole 1513 may formed through a central portion of the non-orbiting end plate 151 in the axial direction. A bolt coupling groove 1514 and a valve fixing groove 1515*a*, 1515*b* may be recessed into an edge portion or edge of an upper surface of the non-orbiting end plate 151 by preset or predetermined depths.

The discharge port 1511 may be located at a position at which a discharge pressure chamber (no reference numeral given) of the first compression chamber V1 and a discharge pressure chamber (no reference numeral given) of the second compression chamber V2 communicate with each other. A discharge guide groove 1517 may be formed on an end of the discharge port 1511. The discharge guide groove 1517 may accommodate an outlet end of the discharge port 1511 and be recessed into the upper surface of the non-orbiting end plate 151 by a preset or predetermined depth. Accordingly, a length of the discharge port 1511 in the axial direction may be shorter than a length (thickness) of the non-orbiting end plate 151 in the axial direction, so as to improve efficiency of the compressor by reducing a dead volume at the discharge port.

Also, the discharge guide groove 1517 may be formed in a long slit (groove) shape having major-axis side surfaces 1517*a* and minor-axis side surfaces 1517*b*. The major-axis side surfaces 1517*a* may be formed to be curved with respect to the radial direction, and the minor-axis side surfaces 1517*b* may be formed to be linear with respect to the radial direction. However, the major-axis side surfaces 1517*a* and the minor-axis side surfaces 1517*b* may alternatively be formed as curved or straight surfaces.

In addition, the major-axis side surfaces 1517*a* and the minor-axis side surfaces 1517*b* may be formed to be perpendicular to the axial direction or may be formed to be inclined. When the major-axis side surfaces 1517*a* and the minor-axis side surfaces 1517*b* are formed to be inclined, the major-axis side surfaces 1517*a* and the minor-axis side surfaces 1517*b* may be formed to be inclined in a direction away from the discharge port 1511. In this case, refrigerant discharged from the discharge port 1511 may be smoothly discharged along the inclined side surfaces. The drawing illustrates an example in which the major-axis side surfaces 1517*a* and the minor-axis side surfaces 1517*b* are formed to be inclined with respect to the axial direction.

The bypass hole 1512 may include a first bypass hole 1512*a* that communicates with the first compression chamber V1 and a second bypass hole 1512*b* that communicates with the second compression chamber V2. The first bypass hole 1512*a* and the second bypass hole 1512*b* may be formed at both sides of the discharge port 1511 with the discharge port 1511 at a center therebetween.

The first bypass hole 1512*a* and the second bypass hole 1512*b* each may be provided with at least two holes, for example, three holes arranged in a row, respectively. However, the first bypass hole 1512*a* and the second bypass hole 1512*b* may be formed in a curved shape along a profile of the non-orbiting wrap 153, rather than having the three holes exactly arranged in a row.

For example, the three holes provided in each of the first bypass hole 1512*a* and the second bypass hole 1512*b* may be formed along a side surface of the non-orbiting wrap 153 to be close to the side surface of the non-orbiting wrap 153 without overlapping the non-orbiting wrap 153. Also, the plurality of holes forming the first bypass hole 1512*a* and the second bypass hole 1512*b* may be formed to have a same inner diameter. However, in some cases, the plurality of holes may be formed to have different inner diameters. For example, a hole located at a middle among the plurality of holes may have an inner diameter larger than diameter of the holes located at both sides of the middle hole.

In addition, the plurality of holes forming each of the first bypass hole 1512*a* and the second bypass hole 1512*b* may communicate together to form a rectangular shape, or each of the first bypass hole 1512*a* and the second bypass hole 1512*b* may be provided with a single rectangular hole.

The scroll-side back pressure hole (hereinafter, referred to as a "first back pressure hole") 1513 may formed through the non-orbiting end plate in the axial direction between adjacent bolt coupling grooves 1514. The first back pressure hole 1513 may be located at a position at which it communicates with a plate-side back pressure hole 1611*a* described hereinafter, and communicate with a compression chamber V having intermediate pressure between suction pressure and discharge pressure.

A plurality of the bolt coupling groove 1514 may be formed on the edge portion of the upper surface of the non-orbiting end plate 151 at preset or predetermined intervals along the circumferential direction. The bolt coupling grooves 1514 may correspond to coupling holes (not shown) provided in a back pressure plate 161 in the axial direction. Accordingly, the non-orbiting scroll 150 and the back pressure plate 161 may be fixedly coupled to each other by coupling bolts (not shown) to the bolt coupling grooves 1514 through the coupling holes (not shown) of the back pressure plate 161.

The valve fixing groove 1515*a*, 1515*b* may be formed through the non-orbiting end plate 151 in the axial direction between several bolt coupling grooves 1514. The valve fixing groove 1515*a*, 1515*b* may be provided for coupling of a bypass valve 1581, 1582 and may include first valve fixing groove 1515*a* and second valve fixing groove 1515*b*. Hereinafter, a valve that opens and closes the first bypass hole 1512*a* in communication with the first compression chamber V1 may be defined as a "first bypass valve" 1581, and a valve for opening and closing the second bypass hole 1512*b* in communication with the second compression chamber V2 may be defined as a "second bypass valve" 1582. Therefore, a valve fixing groove that couples the first bypass valve 1581 may be defined as a "first valve fixing groove" 1515*a*, and a valve fixing groove that couples the second bypass valve 1582 may be defined as a "second valve fixing groove" 1515*b*.

The first bypass hole 1512*a* may be formed at one side of the first valve fixing groove 1515*a*, and the second bypass hole 1512*b* may be formed at one side of the second valve fixing groove 1515*b*. A first valve buffer groove 1516*a* may be formed between the first valve fixing groove 1515*a* and the first bypass hole 1512*a*, and a second valve buffer groove 1516*b* may be formed between the second valve fixing groove 1515*b* and the second bypass hole 1512*b*. The first valve buffer groove 1516*a* and the second valve buffer groove 1516*b* may be recessed into the upper surface of the non-orbiting end plate 151 by preset or predetermined depths so that the first bypass valve 1581 and the second bypass valve 1582 may be smoothly opened and closed.

Accordingly, the first valve fixing groove 1515*a*, the first valve buffer groove 1516*a*, and the first bypass hole 1512*a* may be positioned on a substantially straight line. Further, the second valve fixing groove 1515*b*, the second buffer groove 1516*b*, and the second bypass hole 1512*b* may be positioned on a substantially straight line.

In addition, the first valve fixing groove 1515*a*, the first valve buffer groove 1516*a*, and the first bypass hole 1512*a* may be referred to as a "first bypass" BP1, and the second valve fixing groove 1515*b*, the second valve buffer groove 1516*b*, and the second bypass hole 1512*b* may be referred to as a "second bypass" BP2. The first bypass BP1 and the second bypass BP2 may be disposed so that a center line of the first bypass BP1 and a center line of the second bypass BP2 are parallel to each other.

Also, the first bypass BP1 and the second bypass BP2 may be disposed with the discharge port 1511 interposed therebetween. Accordingly, the discharge port 1511 may be located between the first valve fixing groove 1515*a* and the second valve fixing groove 1515*b*, between the first valve buffer groove 1516*a* and the second valve buffer groove 1516*b*, or between the first bypass hole 1512*a* and the second bypass hole 1512*b*.

The non-orbiting side wall 152 may extend in an annular shape from an edge of the lower surface of the non-orbiting end plate 151 in the axial direction. The non-orbiting side wall 152 may be formed to have substantially a same height as the non-orbiting wrap 153, and a guide protrusion 155 may extend from an outer circumferential surface of the non-orbiting side wall 152 in the radial direction. The guide protrusion 155 may be provided with the guide insertion groove 155*a*.

A plurality of the guide protrusion 155 may be provided disposed at preset or predetermined intervals in the circumferential direction, or may be provided one in number. When a plurality of the guide protrusion 155 is provided, the guide insertion holes 155*a* may be formed through the guide protrusions 155, respectively. On the other hand, when the single guide protrusion 155 is provided, the plurality of guide insertion holes 155*a* may be formed at preset or predetermined intervals in the circumferential direction. FIGS. 2 and 3 illustrate an example in which the plurality of guide protrusions 155 is provided.

A suction guide protrusion 1561 may be formed on one side of an outer circumferential surface of the non-orbiting side wall 152, and the suction guide passage 1562 that guides refrigerant in the low pressure portion 110*a* to a suction pressure chamber (hereinafter, description will be given representatively of the first compression chamber) V11 may be formed in the suction guide protrusion 1561.

The suction guide protrusion 1561 may overlap the refrigerant suction pipe 117 or be at least close to the refrigerant suction pipe 117 when viewed in the axial direction. Accordingly, the suction guide protrusion 1561 may be located at a position at which it is above the refrigerant suction pipe 117 and below the high/low pressure separation plate 115. The suction guide protrusion 1561 may extend between neighboring guide protrusions 155 among the plurality of guide protrusions 155, or may extend from one of the guide protrusions 155.

One or a first end of the suction guide passage 1562 may be open in a direction toward the refrigerant suction pipe 117, and another or a second end may be open in a direction toward the suction pressure chamber V11 forming the compression chamber V. For example, the suction guide passage 1562 may be formed such that the first end forming an inlet is open downward in the direction toward the refrigerant suction pipe 117, and the second end forming an outlet is open radially in the direction toward the compression chamber V. Accordingly, a suction refrigerant flowing into the low pressure portion 110*a* through the refrigerant suction pipe 117 may be suctioned into the suction pressure chamber V11 through the suction guide passage 1562. The suction guide passage 1562 will be described hereinafter together with the suction guide protrusion 1561.

The non-orbiting wrap 153 may be formed in a spiral shape, and may correspond to the orbiting wrap 142 so as to be engaged with the orbiting wrap 142. A description of the non-orbiting wrap 153 will be replaced by the description of the orbiting wrap 142.

The back pressure chamber assembly 160 according to embodiments may be installed on an upper side of the non-orbiting scroll 150. Accordingly, the non-orbiting scroll 150 may be pressed toward the orbiting scroll 140 by back pressure of a back pressure chamber S (more specifically, a force that back pressure applies to the back pressure chamber), so as to seal the compression chamber V.

Referring to FIGS. 1 and 2, the back pressure chamber assembly 160 may include back pressure plate 161 and floating plate 165. The back pressure plate 161 may be coupled to the upper surface of the non-orbiting end plate 151 and the floating plate 165 may be slidably coupled to the back pressure plate 161 to define back pressure chamber 160*a* together with the back pressure plate 161.

The back pressure plate 161 may include a fixed plate portion or plate 1611, a first annular wall portion or wall 1612, and a second annular wall portion or wall 1613. The fixed plate 1611 may be formed in an annular plate shape with a hollow center, and a plate-side back pressure hole (hereinafter, referred to as "second back pressure hole") 1611*a* may be formed through the fixed plate 1611 in the axial direction. The second back pressure hole 1611*a* may communicate with the first back pressure hole 1513 so as to communicate with the back pressure chamber 160*a*. Accordingly, the second back pressure hole 1611*a* may communicate with the first back pressure hole 1513 so that the compression chamber V and the back pressure chamber 160*a* may communicate with each other.

In addition, a bolt coupling hole (not shown) through which a coupling bolt (not shown) may be inserted through the fixed plate 1611 may be formed to correspond to the bolt coupling groove 1514 of the non-orbiting end plate 151 in the axial direction. Accordingly, the back pressure plate 161 may be fixedly coupled to the non-orbiting scroll 150 by the coupling bolt that is coupled to the bolt coupling groove 1514 of the non-orbiting end plate 151 through the bolt coupling hole.

A plurality of the bolt coupling hole may be provided inside of the back pressure chamber 160*a* in the circumferential direction. Accordingly, the back pressure chamber 160*a* may be formed to have an outer diameter as large as possible under the condition that the inner diameter of the casing 110 is the same. Through this, a back pressure area acting on the non-orbiting scroll 150 may be widely formed, so that the non-orbiting scroll 150 may be stably supported.

The first annular wall 1612 and the second annular wall 1613 may be formed on an upper surface of the fixed plate portion 1611 to surround inner and outer circumferential surfaces of the fixed plate 1611. An outer circumferential surface of the first annular wall 1612, an inner circumferential surface of the second annular wall 1613, the upper surface of the fixed plate portion 1611, and a lower surface of the floating plate 165 may define the back pressure chamber 160*a* in the annular shape.

The first annular wall 1612 may be provided with an intermediate discharge port 1612*a* that communicates with the discharge port 1511 of the non-orbiting scroll 150, a valve guide groove 1612*b* in which a check valve 157 may be slidably inserted may be formed in the intermediate discharge port 1612*a*, and a backflow prevention hole 1612*c* may be formed in a central portion of the valve guide groove 1612*b*. Accordingly, the check valve 157 may selectively be opened and closed between the discharge port 151*b* and the intermediate discharge port 1612*a* to suppress discharged refrigerant from flowing back into the compression chamber.

The floating plate 165 may be formed in an annular shape and may be formed of a lighter material than the back pressure plate 161. Accordingly, the floating plate 165 may be attached to and detached from the lower surface of the high/low pressure separation plate 115 while moving in the axial direction with respect to the back pressure plate 161 depending on pressure of the back pressure chamber 160*a*.

For example, when the floating plate 165 is brought into contact with the high/low pressure separation plate 115, the floating plate 165 may serve to seal the low pressure portion 110*a* such that the discharged refrigerant may be discharged to the high pressure portion 110*b* without leaking into the low pressure portion 110*a*.

In the drawings, unexplained reference numerals 1514*a* and 1514*b* denote a first bypass hole receiving groove and a second bypass hole receiving groove.

The scroll compressor according to embodiments may operate as follows.

When power is applied to the stator coil 1212 of the stator 121, the rotor 122 may rotate together with the rotational shaft 125. Then, the orbiting scroll 140 coupled to the rotational shaft 125 may perform the orbiting motion with respect to the non-orbiting scroll 150, thereby forming the pair of compression chambers V between the orbiting wrap 142 and the non-orbiting wrap 153. The compression chambers V may gradually decrease in volume while moving from outside to inside according to the orbiting motion of the orbiting scroll 140.

At this time, a refrigerant may be suctioned into the low pressure portion 110*a* of the casing 110 through the refrigerant suction pipe 117. A portion of the refrigerant may be suctioned directly into the suction pressure chambers V11 of the first compression chamber V1 and the second compression chamber V2, respectively, while the rest of the refrigerant may first flow toward the drive motor 120 and then be suctioned into the suction pressure chambers V11. This will be described hereinafter.

The refrigerant may be compressed while moving along a movement path of the compression chamber V. A portion of the compressed refrigerant may move toward the back pressure chamber 160*a* through the first back pressure hole 1513 before reaching the discharge port 1511. Accordingly, the back pressure chamber 160*a* formed by the back pressure plate 161 and the floating plate 165 may form an intermediate pressure.

The floating plate 165 may rise toward the high/low pressure separation plate 115 to be brought into close contact with the sealing plate 1151 provided on the high/low pressure separation plate 115. Then, the high pressure portion 110*b* of the casing 110 may be separated from the low pressure portion 110*a*, to prevent the refrigerant discharged from each compression chamber V1 and V2 from flowing back into the low pressure portion 110*a*.

On the other hand, the back pressure plate 161 may be lowered by pressure of the back pressure chamber 160*a* applied toward the non-orbiting scroll 150, so as to press the non-orbiting scroll 150 toward the orbiting scroll 140. Accordingly, the non-orbiting scroll 150 may be closely adhered on the orbiting scroll 140 to prevent the compressed refrigerant from leaking from the high-pressure side compression chamber, which forms an intermediate pressure chamber, to a low-pressure side compression chamber.

At this time, the refrigerant may be compressed up to a preset or predetermined pressure while moving from the intermediate pressure chamber to the discharge pressure chamber, but the pressure of the refrigerant may rise above the preset or predetermined pressure due to other conditions occurred during operation of the compressor. Then, some of the refrigerant moving from the intermediate pressure chamber to the discharge pressure chamber may be bypassed in advance from the intermediate pressure chamber forming each compression chamber V1 and V2 toward the high pressure portion 110*b* through the first bypass hole 1512*a* and the second bypass hole 1512*b* before reaching the discharge pressure chamber. Thus, the refrigerant may be prevented from being excessively compressed over the preset or predetermined pressure in the compression chamber, thereby enhancing efficiency of the compressor and ensuring stability of the compressor.

The refrigerant moved to the discharge pressure chamber may be discharged to the high pressure portion 110*b* through the discharge port 1511 and the intermediate discharge port 1612*a* while pushing the check valve 157. The refrigerant may be filled in the high pressure portion 110*b* and then discharged to a condenser of a refrigeration cycle via the refrigerant discharge pipe 118. The series of processes may be repetitively carried out.

The refrigerant discharged to the high pressure portion 110*b* may be in a high-temperature and high-pressure state. The refrigerant in the high-temperature and high-pressure state may be brought into contact with the upper cap 112 and the high/low pressure separation plate 115 constituting the high pressure portion 110*b* to heat the upper cap 112 and the high/low pressure separation plate 115. In particular, as the high/low pressure separation plate 115 serves to separate the inner space of the casing 110 into the low pressure portion 110*a* and the high pressure portion 110*b*, the temperature of the high/low pressure separation plate 115 may be remarkably increased by the refrigerant discharged to the high pressure portion 110*b* during operation of the compressor.

When the temperature of the high/low pressure separation plate 115 is increased, the refrigerant suctioned into the low pressure portion 110*a* may be brought into contact with the high/low pressure separation plate 115 to receive conductive heat or may be heated by radiant heat generated from the high/low pressure separation plate 115. A specific volume of the suctioned refrigerant may increase. When the specific volume of the suctioned refrigerant increases, an amount of refrigerant suctioned into the compression chamber may decrease, thereby lowering efficiency of the compressor.

Accordingly, in embodiments disclosed herein, a type of refrigerant guide may be provided in an inlet of the compression chamber, namely, between the refrigerant suction pipe and the high/low pressure separation plate, to prevent the suctioned refrigerant from being directly or indirectly heated by the high/low pressure separation plate, thereby suppressing an increase in specific volume of the refrigerant suctioned into the compression chamber. Through this, an amount of refrigerant suctioned into the compression chamber may increase, so as to enhance efficiency of the compressor.

Figure 4:
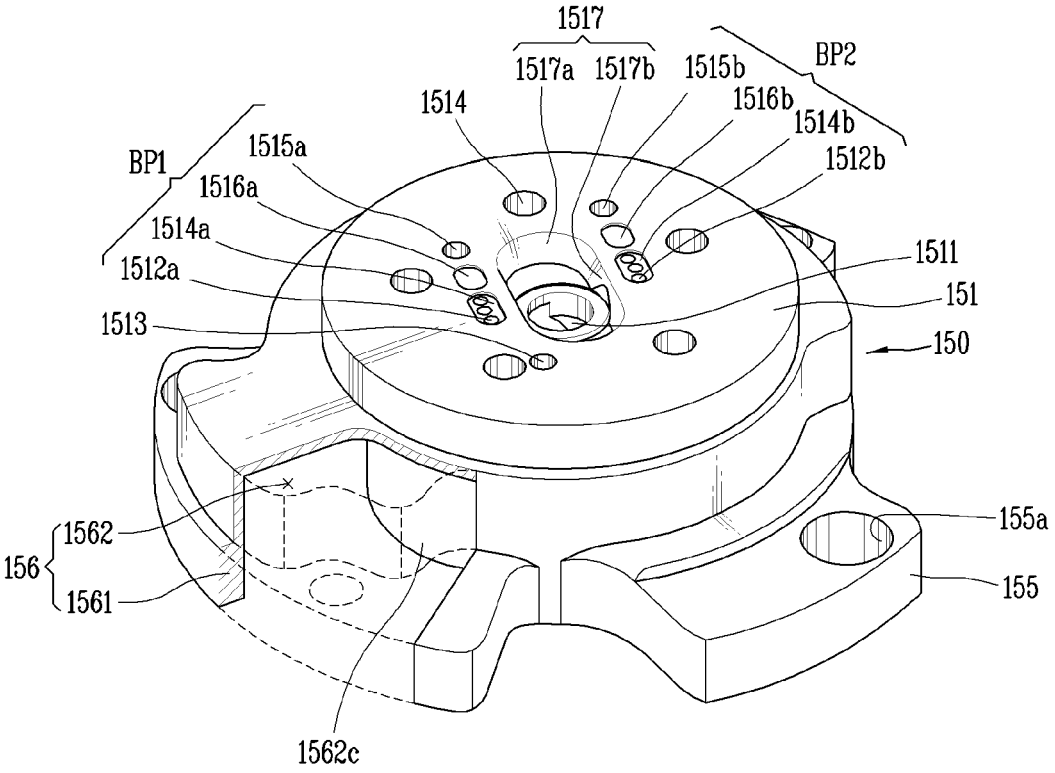
FIG. 4 is a cutout perspective view illustrating a non-orbiting scroll in FIG. 3.
Figure 5:
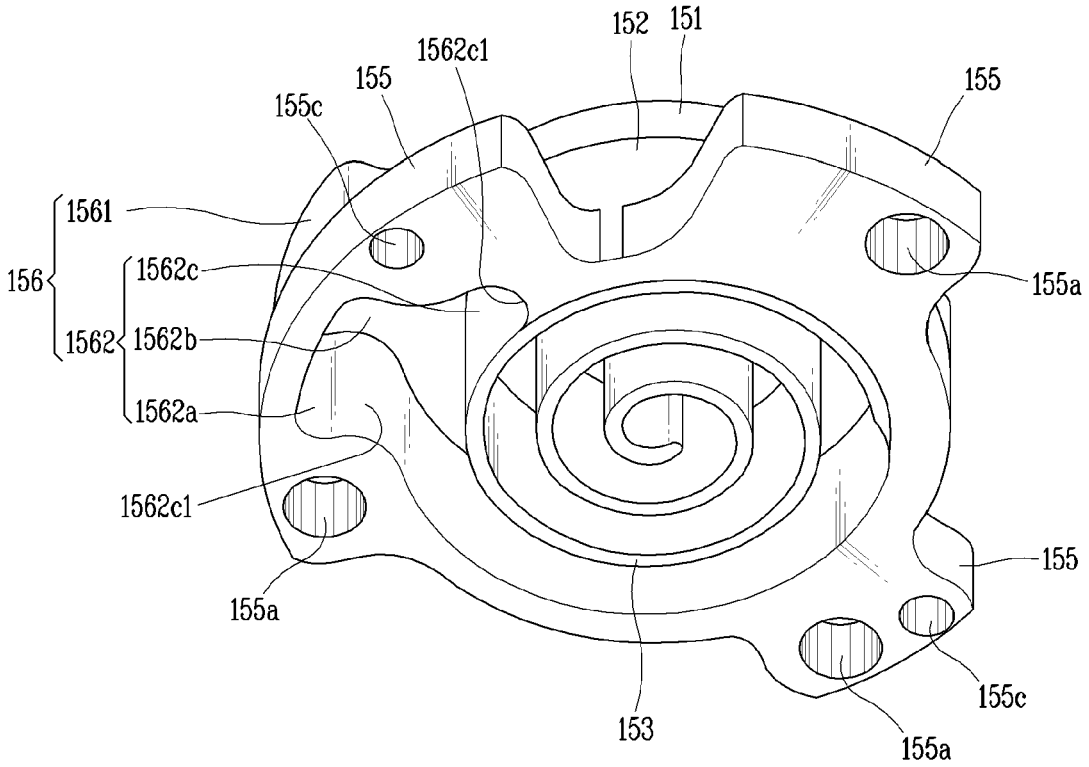
FIG. 5 is a perspective view illustrating the non-orbiting scroll, viewed from the bottom.
Figure 6:
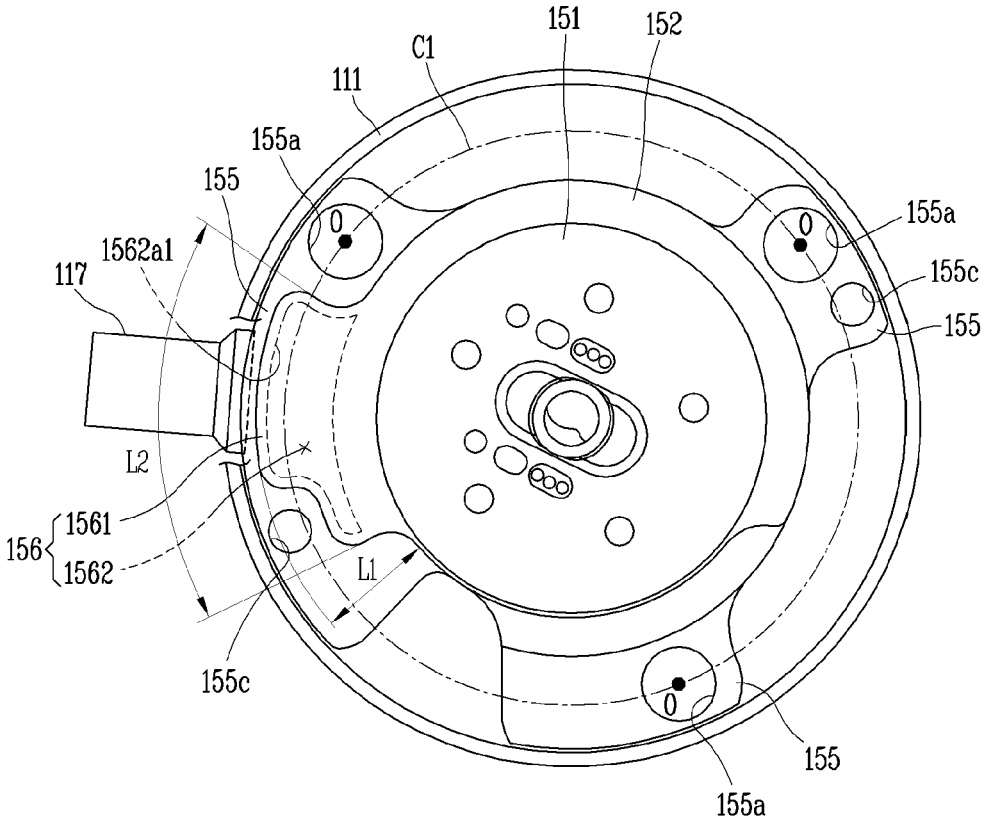
FIG. 6 is a planar view illustrating the non-orbiting scroll, viewed from the top.
Figure 7:
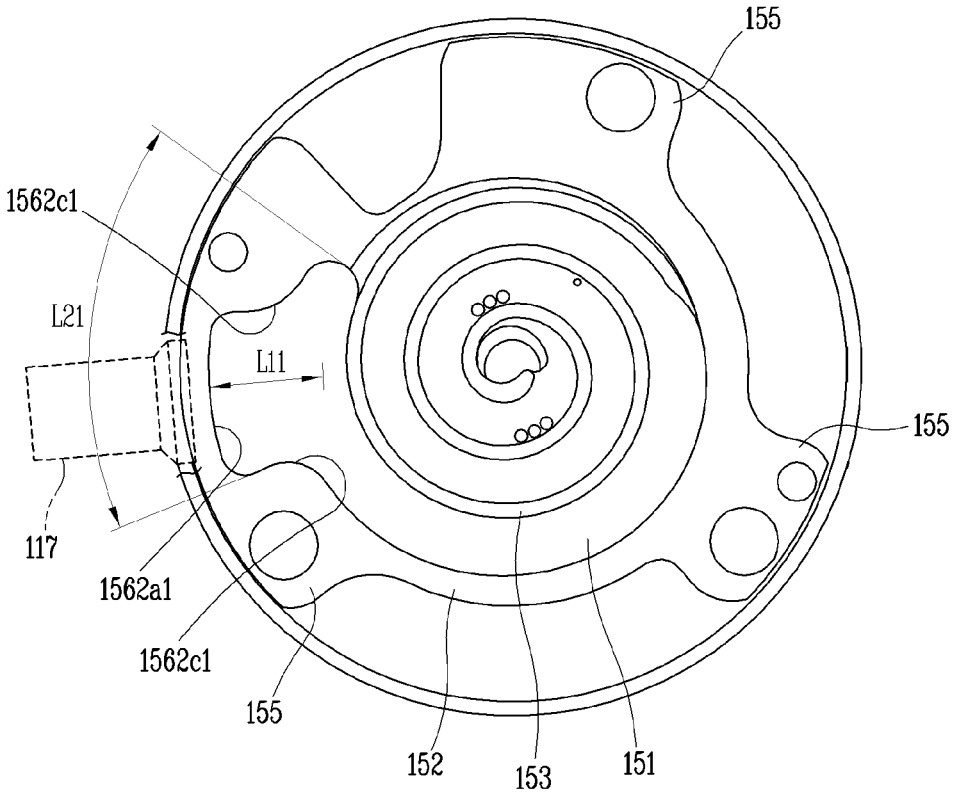
FIG. 7 is a planar view illustrating the non-orbiting scroll, viewed from the bottom.
Figure 8:
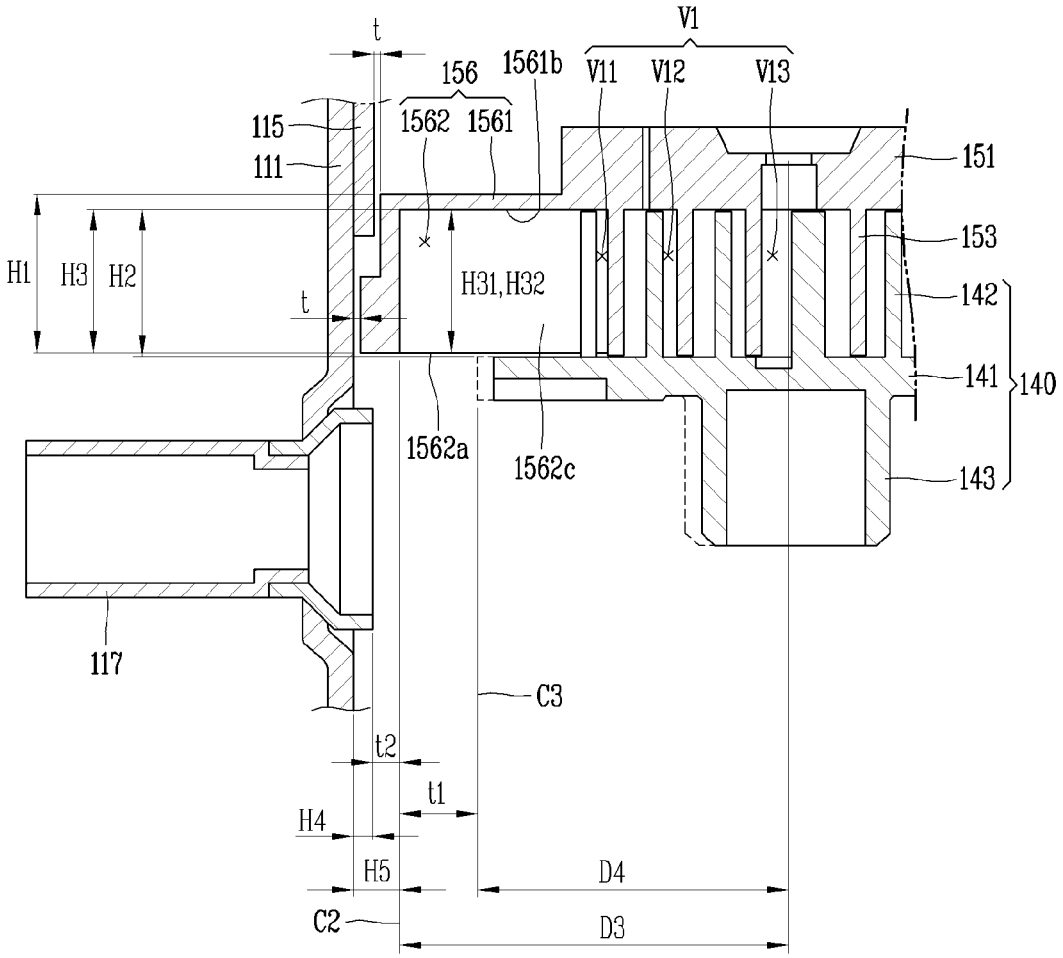
FIG. 8 is a schematic view illustrating a standard of a refrigerant guide in accordance with an embodiment.

FIG. 4 is a cutout perspective view illustrating a non-orbiting scroll in FIG. 3. FIG. 5 is a perspective view illustrating the non-orbiting scroll, viewed from the bottom. FIG. 6 is a planar view illustrating the non-orbiting scroll, viewed from the top. FIG. 7 is a planar view illustrating the non-orbiting scroll, viewed from the bottom. FIG. 8 is a schematic view illustrating a standard of a refrigerant guide in accordance with an embodiment.

The refrigerant guide 156 according to an embodiment may be formed on the non-orbiting scroll 150. The refrigerant guide 156 may be post-assembled to the non-orbiting scroll 150 or may be formed integrally with the non-orbiting scroll 150. This embodiment shows an example in which the refrigerant guide 156 is formed integrally with the non-orbiting scroll 150. Accordingly, compared to separately manufacturing and assembling the refrigerant guide 156, an increase in number of assembly processes of the compressor may be suppressed, thereby reducing a manufacturing costs of the compressor.

Referring to FIGS. 4 and 5, the refrigerant guide 156 according to embodiment may be located between the refrigerant suction pipe 117 and the high/low pressure separation plate 115. For example, the refrigerant guide 156 may be formed such that at least a part or portion thereof is located at a same position as the inlet of the compression chamber V or located higher than the inlet of the compression chamber V. This may result in preventing the refrigerant suctioned into the low pressure portion 110*a* from being directly or indirectly affected by the high/low pressure separation plate 115 or being brought into contact with the high/low pressure separation plate 115.

Referring to FIG. 4, the non-orbiting scroll 150 according to embodiments may include the guide protrusion 155 extending from the outer circumferential surface of the non-orbiting side wall 152 in the radial direction. A plurality of the guide protrusion 155 may be provided disposed at preset or predetermined intervals in the circumferential direction.

The refrigerant guide 156 may be formed to extend in the radial direction, like the guide protrusion 155, between the plurality of guide protrusions 155, or may be formed on one of the plurality of guide protrusions 155. The implementation representatively illustrates an example in which the refrigerant guide 156 is formed on one guide protrusion 155, and this will be exemplarily described. Hereinafter, a guide protrusion provided with the refrigerant guide will be defined as a corresponding guide protrusion.

The corresponding guide protrusion 155 may be formed in a substantially arcuate shape. The corresponding guide protrusion 155 may be formed longer than the other guide protrusions in the circumferential direction. Accordingly, the refrigerant guide 156 may be formed on the corresponding guide protrusion 155.

A guide insertion hole 155*a* may be formed axially through one or a first side of the guide protrusion 155 which is disposed in the circumferential direction, and a reference hole 155*c* for coupling with the main frame 130 may be formed through another or a second side of the guide protrusion 155 in the circumferential direction. The refrigerant guide 156 according to embodiments may be formed between the guide insertion hole 155*a* and the reference hole 155*c*.

Referring to FIGS. 4 and 5, the refrigerant guide 156 according to an embodiment may include the suction guide protrusion 1561 and the suction guide passage 1562. The suction guide protrusion 1561 may extend from the outer circumferential surface of the non-orbiting side wall 152 toward the inner circumferential surface of the cylindrical shell 111, and the suction guide passage 1562 may be formed through the inside of the suction guide protrusion 1561. Accordingly, the refrigerant guide 156 may be formed such that the low pressure portion 110*a* and the compression chamber (more specifically, the inlet of the suction pressure chamber) V may communicate with each other.

The suction guide protrusion 1561 may protrude in the axial direction from an upper surface of the corresponding guide protrusion 155 toward the high/low pressure separation plate 115 by a predetermined height, and extend in the radial direction from the outer circumferential surface of the non-orbiting side wall 152 toward the inner circumferential surface of the cylindrical shell 111. The suction guide protrusion 1561 may be formed such that its outer circumferential surface is adjacent to the inner circumferential surface of the cylindrical shell 111 while being spaced apart by a preset or predetermined interval (hereinafter, referred to as an "insulation interval") t or is adjacent to the inner circumferential surface of the high/low pressure separation plate 115 while being spaced apart by a preset or predetermined insulating interval t (see FIG. 8). Accordingly, the suction guide protrusion 1561 may prevent heat from being transferred from the cylindrical shell 111 or the high/low pressure separation plate 115 and simultaneously divide suction guide space between the refrigerant suction pipe 117 and the high/low pressure separation plate into a lower space and an upper space. More specifically, the suction guide protrusion 1561 may be formed such that at least part or a portion thereof overlaps a virtual circle C1 that connects centers O of the guide insertion holes 155*a* provided in the plurality of guide protrusions 155, respectively.

In addition, referring to FIGS. 4 and 8, the suction guide protrusion 1561 may be formed at a position at which at least part or a portion thereof overlaps the refrigerant suction pipe 117 when viewed in the axial direction. In other words, the suction guide protrusion 1561 may overlap the suction guide space S between the frame fixing portions 136 adjacent to each other on the main frame 130 when viewed in the axial direction.

Accordingly, the suction guide passage 1562 described hereinafter may be formed at a position corresponding to the refrigerant suction pipe 117 in the axial direction, thereby minimizing a distance between the refrigerant suction pipe 117 and the suction guide passage 1562. This may allow the refrigerant to be quickly suctioned into the suction guide passage 1562 through the low pressure portion 110*a*.

Also, referring to FIG. 6, the suction guide protrusion 1561 may be formed in an approximately arcuate shape when viewed in the axial direction. For example, the suction guide protrusion 1561 may be formed such that a length L2 thereof in an arcuate direction is longer than a length L1 in the radial direction. Accordingly, an overlap length by which the suction guide passage 1562 overlaps the refrigerant suction pipe 117 in the circumferential direction is longer, so that the refrigerant suctioned through the low pressure portion 110*a* may be quickly suctioned into the suction guide passage 1562.

In addition, referring to FIG. 8, the suction guide protrusion 1561 may be formed such that a height H1 thereof in the axial direction is higher than or equal to a wrap height H2 of the non-orbiting wrap 153. Accordingly, a height H3 of the suction guide passage 1562 in the axial direction may be higher than or equal to the wrap height H2 of the non-orbiting wrap 153. This may result in lowering flow resistance against the refrigerant suctioned from the suction guide passage 1562 to the suction pressure chamber V11.

The suction guide passage 1562 may be formed through an inside of the suction guide protrusion 1561. For example, referring to FIGS. 5 to 8, the suction guide passage 1562 according to an embodiment may include passage inlet 1562*a*, passage connection portion 1562*b*, and passage outlet portion or outlet 1562*c*. The passage inlet 1562*a* may be opened toward the refrigerant suction pipe 117, the passage connection 1562*b* may extend from the passage inlet 1562*a* toward the compression chamber V, and the passage outlet portion 1562*c* may be opened toward the suction pressure chamber V11 forming the compression chamber V such that the passage connection portion 1562*b* communicates with the compression chamber V.

More specifically, one or a first end of the suction guide passage 1562 which defines the passage inlet 1562*a* and faces the refrigerant intake pipe 117 may be opened downward in the axial direction toward the drive motor 120 or the main frame 130, and another or a second end of the suction guide passage 1562 which defines the passage outlet 1562*c* and faces the suction pressure chamber V11 forming the compression chamber V may be open toward the outer surface of the non-orbiting wrap 153 in the radial direction. In addition, a portion between the ends of the suction guide passage 1562 in a direction toward the high/low pressure separation plate 115 may be covered.

Accordingly, the suction guide passage 1562 may be formed linearly when viewed in the axial direction while being bent with its upper surface closed when viewed in the radial direction, so that a cross-section of the passage inlet 1562*a* may be orthogonal to a cross-section of the passage outlet 1562*c*. With this structure, a surface of the refrigerant guide 156 that faces the high/low pressure separation plate 115 may be blocked by the passage connection portion 1562*c*, so that refrigerant cannot be brought into contact with the high/low pressure separation plate 115. At the same time, the refrigerant guide 156 may suppress radiant heat, which is radiated from the high/low pressure separation plate 115, from being transferred to the refrigerant. This may result in preventing the refrigerant suctioned into the compression chamber from the low pressure portion 110*a* from being preheated by the high/low pressure separation plate 115, and suppressing an increase in specific volume of the refrigerant suctioned into the compression chamber, thereby improving efficiency of the compressor.

The suction guide passage 1562 according to embodiments may be formed to have a length L21 in the circumferential direction which is long enough to accommodate at least a part or portion of the refrigerant suction pipe 117. The passage inlet 1562*a* may be formed such that its length L11 in the radial direction is longer than the length L21 in the circumferential direction and its inner circumferential side has a cut open end. In addition, the passage inlet 1562*a* may be formed to overlap at least a part or portion of the refrigerant suction pipe 117 within a range thereof in the circumferential direction (see FIGS. 5 and 6).

Accordingly, a distance between the refrigerant suction pipe 117 and the suction guide passage 1562 may be as short as possible, thereby minimizing a flow distance by which the refrigerant suctioned into the low pressure portion 110*a* flows into the suction guide passage 1562. With this configuration, the refrigerant in the low pressure portion 110*a* may be quickly introduced into the suction guide passage 1562, thereby increasing an amount of suctioned refrigerant.

Also, referring to FIG. 8, a maximum distance t1 between the inner circumferential surface of the suction guide passage 1562 and the outer circumferential surface of the orbiting scroll 140 may be formed to be longer than or equal to an orbiting radius of the orbiting scroll 140. For example, a radius D3 of a virtual line C2 that connects an outer wall surface 1562*a*1 of the passage inlet 1562*a* may be larger than a maximum radius D4 of a virtual line C3 that is drawn along an orbiting trajectory of the orbiting scroll 140 during the orbiting motion of the orbiting scroll 140. This may result in preventing the passage inlet 1562*a* of the suction guide passage 1562 from being blocked by the orbiting end plate 141 of the orbiting scroll 140 even if the orbiting scroll 140 performs the orbiting motion. Accordingly, at least a part or portion of the suction guide passage 1562 may always be open, and thus, the amount of refrigerant suctioned into the compression chamber V may be ensured, thereby improving efficiency of the compressor.

Further, referring to FIG. 8, the passage inlet 1562*a* of the suction guide passage 1562 may be spaced apart from the refrigerant suction pipe 117 by a preset interval t2 in the axial direction. Accordingly, a part or portion of the refrigerant suctioned into the low pressure portion 110*a* through the refrigerant suction pipe 117 may move toward the drive motor 120 provided below the suction guide passage 1562 so as to effectively cool the drive motor 120.

In addition, referring to FIG. 8, a depth of the suction guide passage 1562 in the axial direction may be smaller than or equal to a height of the compression chamber V in the axial direction. For example, a height H31 of the passage connection portion 1562*b* in the axial direction or a height H32 of the passage outlet 1562*c* in the axial direction may be lower than or equal to a wrap height H2 of the non-orbiting wrap.

Accordingly, formation of a stepped portion on the passage outlet 1562*c* of the suction guide passage 1562 may be prevented in advance. With this configuration, flow resistance against a suctioned refrigerant may be reduced, thereby improving efficiency of the compressor.

Also, referring to FIG. 8, the suction guide passage 1562 may be formed such that its inner surfaces are orthogonal. For example, as the passage inlet 1562*a* and the passage outlet 1562*c* are orthogonal to each other, an inner surface of the passage connection portion 1562*b* facing the high/low pressure separation plate 115 may be to have a bent cross-section. Accordingly, the passage connection portion 1562*b* may be easily manufactured, and also, a volume of the suction guide passage 1562 may be secured as wide as possible.

Further, referring to FIG. 6, the suction guide passage 1562 may be formed such that its outlet is round. For example, the passage outlet 1562*c* may extend in a direction from the open end of the passage inlet 1562*a* toward the high/low pressure separation plate 115, and a connection surface 1561*c*1 at which the passage outlet 1562*c* and the compression chamber (more specifically, the suction pressure chamber) are connected to each other may be rounded. Accordingly, flow resistance against refrigerant flowing from the passage outlet 1562*c* to the suction pressure chamber V11 may be reduced. With this configuration, the refrigerant may quickly move along the rounded connection surface 1561*c*1, thereby increasing the amount of suctioned refrigerant.

Further, referring to FIG. 8, the refrigerant suction pipe 117 may be formed such that its outlet end is closer to the inner circumferential surface of the casing 110 than the inlet of the suction guide passage 1562. For example, referring to FIG. 8, a suction pipe height H4 from the inner circumferential surface of the cylindrical shell 111 to the outlet end of the refrigerant suction pipe 117 may be lower than a passage height H5 from the inner circumferential surface of the cylindrical shell 111 to the passage inlet 1562*a*.

Accordingly, a use area of the suction guide passage which is capable of forming the passage inlet 1562*a* of the suction guide passage 1562 for the refrigerant suction pipe 117 may be maximized. With the configuration, the refrigerant suctioned into the low pressure portion 110*a* of the casing 110 through the refrigerant suction pipe 117 may be guided to the suction guide passage 1562 as much as possible, thereby increasing the amount of suctioned refrigerant. As such, when the refrigerant guide is provided between the refrigerant suction pipe and the high/low pressure separation plate as described above, heating of suctioned refrigerant before being suctioned into the compression chamber may be suppressed, thereby increasing the amount of suctioned refrigerant, and thus, improving efficiency of the compressor.

Figure 9:
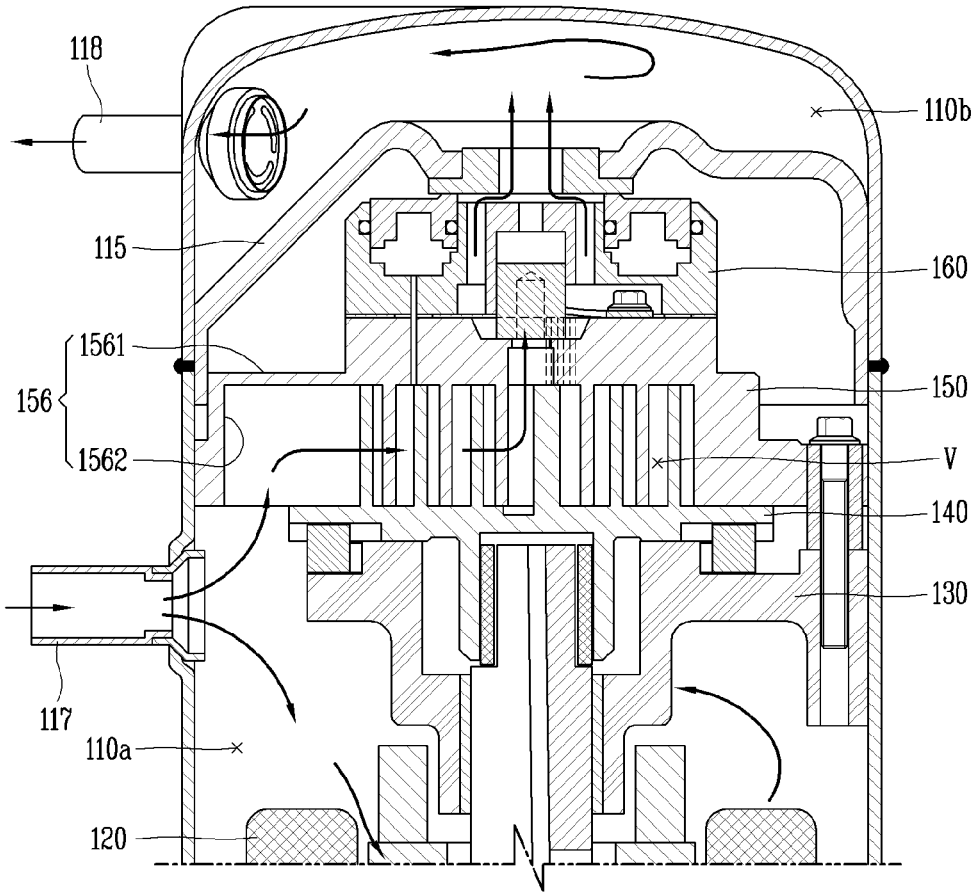
FIG. 9 is a cross-sectional view illustrating a process of suctioning refrigerant into a scroll compressor in accordance with an embodiment.

FIG. 9 is a cross-sectional view illustrating a process of suctioning a refrigerant into a scroll compressor in accordance with an embodiment. Referring to FIG. 9, a refrigerant may be suctioned into the low pressure portion 110*a* of the casing 110 through the refrigerant suction pipe 117. The suctioned refrigerant may be divided such that some moves to a lower half portion and the rest may moves to an upper half portion.

The refrigerant moving to the lower half portion may be brought into contact with the drive motor 120 to cool the drive motor 120 while circulating along the low pressure portion 110*a*, and then flow upward again to be suctioned into the compression chamber V through the refrigerant guide passage 1562. The refrigerant moving to the upper half portion may be suctioned directly into the compression chamber V through the refrigerant guide passage 1562. Accordingly, the refrigerant moving to the upper half portion may not come into contact with the drive motor 120, and thus, an increase in specific volume of the refrigerant suctioned into the compression chamber V may be reduced, thereby improving efficiency of the compressor.

In addition, as the refrigerant guide passage 1562 constituting a suction passage is separated from the high/low pressure separation plate 115 by the refrigerant guide protrusion 1561, the refrigerant flowing into the suction guide passage 1562 may be prevented from being brought into contact with the high/low pressure separation plate 115 and simultaneously radiant heat generated in the high/low pressure separation plate 115 may be blocked. Accordingly, the specific volume of the refrigerant suctioned through the suction guide passage 1562 may be further reduced, thereby further improving efficiency of the compressor.

Hereinafter, description will be given of another embodiment of a passage connection portion.

That is, the previous embodiment illustrates that the passage connection portion is formed by being bent at a right angle, but in some cases, the passage connection portion may be formed to be inclined or curved.

Figure 10:
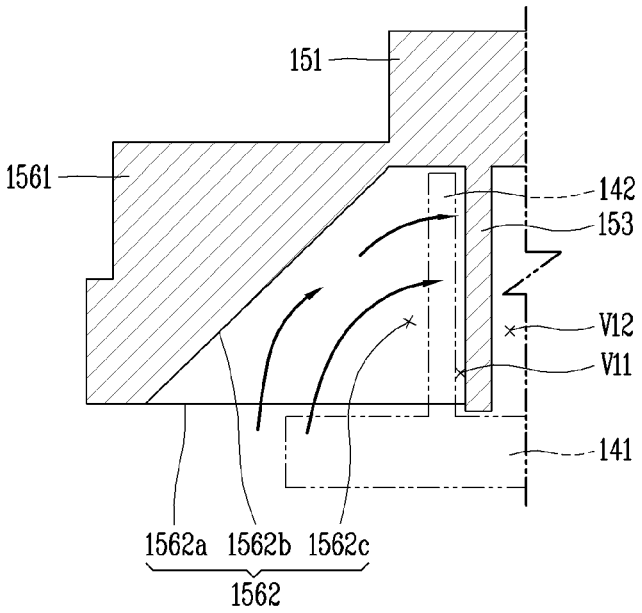
FIGS. 10 and 11 are cross-sectional views illustrating the refrigerant guide according to different embodiments.
Figure 11:
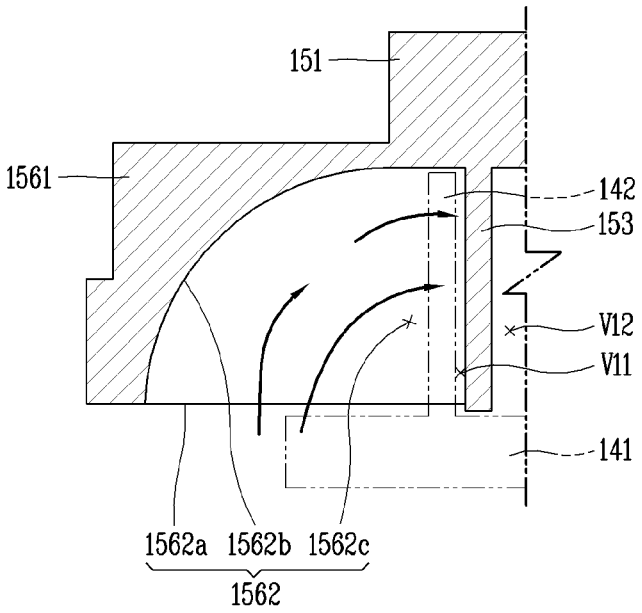

FIGS. 10 and 11 are cross-sectional views illustrating the refrigerant guide according to different embodiments. For example, a passage connection portion 1562*b* may be formed in a cross-sectional shape inclined with respect to the axial direction, as illustrated in FIG. 9, or may be formed in a curved cross-sectional shape, as illustrated in FIG. 10.

In this case, the passage connection portion 1562*b* may be formed such that only its outer wall surface is inclined or curved. However, in some cases, in addition to the outer wall surface, both inner wall surfaces (not shown) in the circumferential direction may also be inclined or curved.

As described above, when the passage connection portion 1562*b* is formed to be inclined or curved, a vortex of refrigerant at the passage connection portion 1562*b* may be suppressed, thereby suppressing suction loss due to flow loss of the refrigerant. In this manner, the refrigerant may rapidly flow into the suction pressure chamber, thereby improving efficiency of the compressor.

In the previous embodiment, the outlet end of the refrigerant suction pipe is formed to be orthogonal to the center line of the refrigerant suction pipe. However, in some cases, the outlet end of the refrigerant suction pipe may alternatively be inclined or bent.

Figure 12:
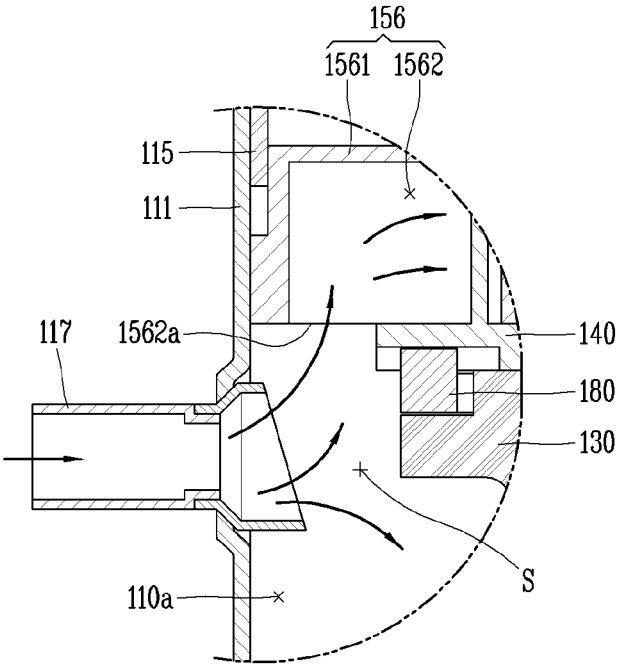
FIGS. 12 and 13 are cross-sectional views illustrating a refrigerant suction pipe according to different embodiments.
Figure 13:
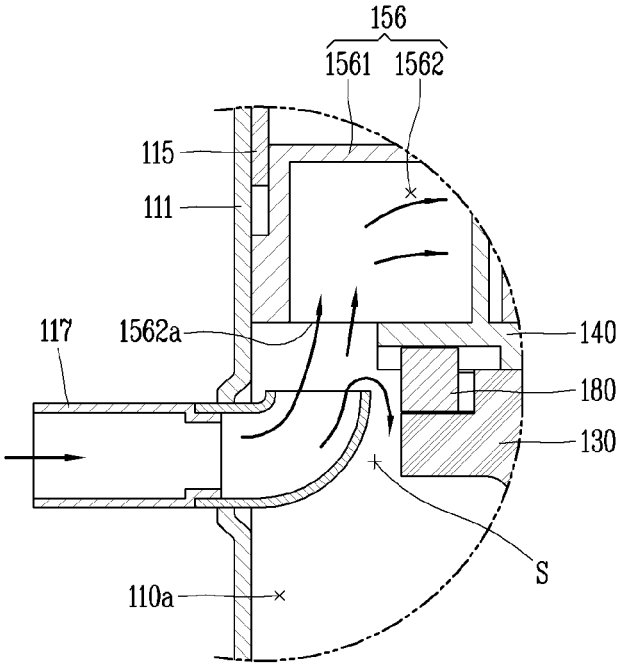

FIGS. 12 and 13 are cross-sectional views illustrating the refrigerant suction pipe according to different embodiments. Referring to FIG. 12, the refrigerant suction pipe 117 according to embodiments may be formed to be inclined such that the outlet end thereof faces the passage inlet 1562*a* of the suction guide passage 1562. Accordingly, some of the refrigerant suctioned into the low pressure portion 110*a* through the refrigerant suction pipe 117 may flow in a direction inclined toward the passage inlet 1562*a* of the suction guide passage 1562. In this manner, a relatively large amount of refrigerant may be guided to the suction guide passage 1562, thereby increasing the amount of suctioned refrigerant.

Further, referring to FIG. 13, the outlet end of the refrigerant suction pipe 117 may be formed by being bent toward the passage inlet 1562*a* of the suction guide passage 1562. Even in this case, the refrigerant may flow similarly to the embodiment of FIG. 1 described above. However, in this embodiment, as the outlet end of the refrigerant suction pipe 117 is bent at a right angle (or inclined angle) toward the suction guide passage 1562, more refrigerant may be guided to the suction guide passage 1562, so that the amount of suction refrigerant may further increase.

Embodiments disclosed herein have illustrated an example in which the refrigerant guide is formed integrally by extending from the non-orbiting scroll, but in some cases, the refrigerant guide may be separately manufactured and post-assembled to the non-orbiting scroll. In this case, the refrigerant guide may be formed of an insulating material, such as plastic. Even in this case, as the refrigerant guide has a basic configuration and operation effects similar to those of the previous embodiments, repetitive description thereof has been omitted.

Also, the refrigerant guide may be assembled on the inner circumferential surface of the casing. In this case, the refrigerant guide may be formed to extend from the outlet end of the refrigerant suction pipe. Even in this case, as the refrigerant guide has a basic configuration and operation effects similar to those of the previous embodiments, repetitive description thereof has been omitted.

Embodiments disclosed herein provide a scroll compressor capable of lowering a specific volume of a suction refrigerant in a low-pressure type. Embodiments disclosed herein also provide a scroll compressor capable of lowering a specific volume of a suction refrigerant by shortening a path through which the suction refrigerant is suctioned into a compression chamber.

Embodiments disclosed herein further provide a scroll compressor capable of suppressing a suction refrigerant from coming in contact with a high/low pressure separation plate by installing a refrigerant guide above an outlet side of a refrigerant suction pipe. Embodiments disclosed herein furthermore provide a scroll compressor capable of preventing beforehand an increase in number of assembly processes due to formation of a refrigerant guide by forming the refrigerant guide integrally with an existing member, and thus, reducing manufacturing costs of the compressor including the refrigerant guide.

Embodiments disclosed herein provide a scroll compressor that may include a high/low pressure separation plate configured to separate an inner space of a casing into a lower space and an upper space, a refrigerant suction pipe that communicates with the lower space of the casing, a refrigerant discharge pipe that communicates with the upper space of the casing, a compression unit disposed such that a suction pressure chamber is located above the refrigerant suction pipe, and a refrigerant guide located between an outlet of the refrigerant suction pipe and the suction pressure chamber of the compression unit. The refrigerant guide may be open downward in a direction toward the suction pressure chamber. In addition, the refrigerant guide may have a shape in which side surfaces thereof in a radial direction and an upper surface, except for a side surface facing the suction pressure chamber in the radial direction, are blocked.

Embodiments disclosed herein provide a scroll compressor that may include a casing having a low pressure portion and a high pressure portion, a refrigerant suction pipe that communicates with the low pressure portion and a refrigerant discharge pipe that communicates with the high pressure portion, a drive motor installed inside of the low pressure portion, an orbiting scroll coupled to the drive motor to perform an orbiting motion, a non-orbiting scroll engaged with the orbiting scroll to form a compression chamber, and a refrigerant guide provided on the non-orbiting scroll to guide a refrigerant suctioned into the low pressure portion to be suctioned into the compression chamber. The refrigerant guide may integrally extend from an outer circumferential surface of the non-orbiting scroll.

In addition, the scroll compressor may further include a high/low pressure separation plate provided inside of the casing to separate an inside of the casing into the low pressure portion and the high pressure portion. The refrigerant guide may be located between the refrigerant suction pipe and the high/low pressure separation plate. The refrigerant guide may integrally extend from an outer circumferential surface of the non-orbiting scroll toward an inner circumferential surface of the casing. The refrigerant guide may be spaced apart from the high/low pressure separation plate by a preset or predetermined interval.

Embodiments disclosed herein provide a scroll compressor that may include a casing, a high/low pressure separation plate configured to separate an inner space of the casing into a low pressure portion and a high pressure portion, a refrigerant suction pipe that communicates with the low pressure portion, a refrigerant discharge pipe that communicates with the high pressure portion, an orbiting scroll provided in the low pressure portion of the casing to perform an orbiting motion, and including an orbiting end plate disposed adjacent to the refrigerant suction pipe, and an orbiting wrap that extends from the orbiting end plate, a non-orbiting wrap provided on one side of the orbiting scroll, and including a non-orbiting end plate, a non-orbiting wrap that extends from the non-orbiting end plate and engaged with the orbiting wrap to form a compression chamber, and a non-orbiting side wall portion or side wall that extends from an edge of the non-orbiting end plate in an axial direction, the non-orbiting wrap having an end spaced apart from the refrigerant suction pipe, a suction guide protrusion that extends from the non-orbiting side wall portion of the non-orbiting scroll toward an inner circumferential surface of the casing, and a suction guide passage formed through an inside of the suction guide protrusion such that the low pressure portion and the compression chamber communicate with each other. The suction guide protrusion may be adjacent to the inner circumferential surface of the casing or an inner circumferential surface of the high/low pressure separation plate, with being spaced apart by a preset or predetermined interval.

One or a first end of the suction guide passage may be open in a direction toward the refrigerant suction pipe, and another or a second end of the suction guide passage may be open in a direction toward the compression chamber. A portion between the both ends of the suction guide passage in a direction toward the high/low pressure separation plate may be covered.

A length of the suction guide passage in a circumferential direction may overlap at least part or a portion of the refrigerant suction pipe when viewed in an axial direction. A maximum interval between an inner circumferential surface of the suction guide passage and an outer circumferential surface of the orbiting scroll may be larger than or equal to an orbiting radius of the orbiting scroll.

The orbiting scroll may be provided with the orbiting wrap, and the non-orbiting scroll may be provided with the non-orbiting wrap engaged with the orbiting wrap to form the compression chamber. A depth of the suction guide passage in the axial direction may be smaller than or equal to a wrap height of the non-orbiting wrap.

The suction guide passage may include a passage inlet portion or inlet open toward the low pressure portion, a passage connection portion that extends from the passage inlet portion toward the compression chamber, and a passage outlet portion or outlet that communicates the passage connection portion with the compression chamber. A cross-section of the passage inlet portion and a cross-section of the passage outlet portion may be orthogonal to each other. The passage inlet portion may be formed in an arcuate cross-sectional shape extending along the circumferential direction, and provided with a cut open end on an inner circumferential side thereof.

The passage connection portion may be formed in an arcuate cross-sectional shape extending from the passage inlet portion toward the high/low pressure separation plate. The passage connection portion may be formed such that a surface thereof facing the high/low pressure separation plate has a bent cross-sectional shape. The passage connection portion may be formed such that a surface thereof facing the high/low pressure separation plate has a cross-sectional shape that is inclined or curved with respect to the axial direction.

The passage outlet portion may extend from an open end of the passage inlet portion toward the high/low pressure separation plate. A connection surface that connects the passage outlet portion and the compression chamber to each other may be rounded.

The non-orbiting scroll may be provided with a guide protrusion radially extending along a circumferential direction. The suction guide protrusion may be recessed into the guide protrusion by a preset or predetermined depth in a direction toward the high/low pressure separation plate.

A plurality of the guide protrusion may be provided spaced apart from one another by preset or predetermined intervals along a circumferential direction of the non-orbiting scroll. The suction guide protrusion may be formed between the plurality of guide protrusions adjacent to each other.

The plurality of guide protrusions may be provided with guide insertion holes formed therethrough in the axial direction, respectively. The suction guide protrusion may be formed such that at least part or a portion thereof is located on a virtual circle that connects centers of the plurality of guide insertion holes adjacent to one another.

The refrigerant suction pipe may be formed such that an outlet end thereof is closer to an inner circumferential surface of the casing than an inlet of the suction guide passage. The refrigerant suction pipe may be configured such that the outlet end is inclined toward the inlet of the suction guide passage.

A back pressure chamber assembly may be provided on one side surface of the non-orbiting scroll in the axial direction. The non-orbiting scroll may move up and down in the axial direction by the back pressure chamber assembly during operation.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a high/low pressure separation plate configured to separate an inner space of the casing into a low pressure portion and a high pressure portion;

a refrigerant suction pipe that communicates with the low pressure portion;

a refrigerant discharge pipe that communicates with the high pressure portion;

an orbiting scroll provided in the low pressure portion of the casing to perform an orbiting motion, and including an orbiting end plate, and an orbiting wrap that extends from the orbiting end plate, wherein the orbiting end plate is disposed adjacent to the refrigerant suction pipe;

a non-orbiting scroll provided on one side of the orbiting scroll, and including a non-orbiting end plate, a non-orbiting wrap that extends from the non-orbiting end plate and engaged with the orbiting wrap to form a compression chamber, and a non-orbiting side wall that extends from an edge of the non-orbiting end plate in an axial direction, the non-orbiting wrap having an end spaced apart from the refrigerant suction pipe;

a suction guide protrusion that extends from the non-orbiting side wall of the non-orbiting scroll toward an inner circumferential surface of the casing;

a suction guide passage formed by an inside of the suction guide protrusion such that the low pressure portion and the compression chamber communicate with each other, wherein a back pressure chamber assembly is provided on one side surface of the non-orbiting scroll in the axial direction, and wherein the non-orbiting scroll moves up and down in the axial direction by the back pressure chamber assembly during operation; and wherein the suction guide passage overlaps in a circumferential direction at least a portion of the refrigerant suction pipe when viewed in the axial direction, and a maximum interval between an inner circumferential surface of the suction guide passage and an outer circumferential surface of the orbiting scroll is larger than or equal to an orbiting radius of the orbiting scroll.

2. The scroll compressor of claim 1, wherein the suction guide protrusion is disposed adjacent to the inner circumferential surface of the casing or an inner circumferential surface of the high/low pressure separation plate and spaced apart therefrom by a predetermined interval.

3. The scroll compressor of claim 1, wherein a first end of the suction guide passage is open in a direction toward the refrigerant suction pipe, wherein a second end of the suction guide passage is open in a direction toward the compression chamber, wherein a portion between the first and second ends of the suction guide passage in a direction toward the high/low pressure separation plate is covered, and wherein an outer circumferential surface of a refrigerant guide facing the inner circumferential surface of the casing is spaced apart from the inner circumferential surface of the casing and an inner circumferential surface of the high/low pressure separation plate by a predetermined distance in a radial direction.

4. The scroll compressor of claim 1, wherein a depth of the suction guide passage in the axial direction is smaller than or equal to a wrap height of the non-orbiting wrap.

5. The scroll compressor of claim 1, wherein the suction guide passage comprises a passage inlet open toward the low pressure portion, a passage connection portion that extends from the passage inlet toward the compression chamber, and a passage outlet that communicates the passage connection portion with the compression chamber, and wherein a cross-section of the passage inlet and a cross-section of the passage outlet are orthogonal to each other.

6. The scroll compressor of claim 5, wherein the passage inlet has an arcuate cross-sectional shape that extends along a circumferential direction, and is provided with a cut open end on an inner circumferential side thereof.

7. The scroll compressor of claim 5, wherein the passage connection portion has an arcuate cross-sectional shape that extends from the passage inlet toward the high/low pressure separation plate, and wherein the passage connection portion is formed such that a surface thereof facing the high/low pressure separation plate has a bent cross-sectional shape.

8. The scroll compressor of claim 5, wherein the passage connection portion has an arcuate cross-sectional shape that extends from the passage inlet toward the high/low pressure separation plate, and wherein the passage connection portion is formed such that a surface thereof facing the high/low pressure separation plate has a cross-sectional shape that is inclined or curved with respect to the axial direction.

9. The scroll compressor of claim 5, wherein the passage outlet extends from an open end of the passage inlet toward the high/low pressure separation plate, and wherein a connection surface that connects the passage outlet and the compression chamber to each other is rounded.

10. The scroll compressor of claim 1, wherein the non-orbiting scroll is provided with at least one guide protrusion that radially extends along the circumferential direction, and wherein the suction guide protrusion is recessed into the at least one guide protrusion by a predetermined depth in a direction toward the high/low pressure separation plate.

11. The scroll compressor of claim 10, wherein the at least one guide protrusion comprises a plurality of guide protrusions provided spaced apart from one another by predetermined intervals along the circumferential direction of the non-orbiting scroll, and wherein the suction guide protrusion is formed between the plurality of guide protrusions adjacent to each other.

12. The scroll compressor of claim 11, wherein the plurality of guide protrusions is provided with guide insertion holes formed therethrough in the axial direction, respectively, and wherein the suction guide protrusion is formed such that at least a portion thereof is located on a virtual circle connecting centers of the plurality of guide insertion holes adjacent to one another.

13. The scroll compressor of claim 1, wherein the refrigerant suction pipe is formed such that an outlet end thereof is closer to an inner circumferential surface of the casing than an inlet of the suction guide passage.

14. The scroll compressor of claim 13, wherein the refrigerant suction pipe is configured such that the outlet end is inclined toward the inlet of the suction guide passage.

15. A scroll compressor, comprising:

a casing having a low pressure portion and a high pressure portion;

a refrigerant suction pipe that communicates with the low pressure portion and a refrigerant discharge pipe that communicates with the high pressure portion;

a drive motor installed inside of the low pressure portion;

an orbiting scroll coupled to the drive motor to perform an orbiting motion;

a non-orbiting scroll engaged with the orbiting scroll to form a compression chamber; and a refrigerant guide that extends radially outward from the non-orbiting scroll, the refrigerant guide directing a refrigerant suctioned into the low pressure portion into the compression chamber, wherein the refrigerant guide forms a suction guide passage, and wherein the suction guide passage overlaps in a circumferential direction at least a portion of the refrigerant suction pipe when viewed in the axial direction, and a maximum interval between an inner circumferential surface of the suction guide passage and an outer circumferential surface of the orbiting scroll is larger than or equal to an orbiting radius of the orbiting scroll.

16. The scroll compressor of claim 15, wherein the refrigerant guide integrally extends in the radially direction from an outer circumferential surface of the non-orbiting scroll and then in an axial direction toward the refrigerant suction pipe, and wherein an outer circumferential surface of the refrigerant guide facing the inner circumferential surface of the casing is spaced apart from the inner circumferential surface of the casing and an inner circumferential surface of the high/low pressure separation plate by a predetermined distance in a radial direction.

17. The scroll compressor of claim 16, wherein a first end of the suction guide passage is open in the axial direction toward the refrigerant suction pipe, wherein a second end of the suction guide passage is open in the radial direction toward the compression chamber, and wherein a connection portion between the first and second ends of the suction guide passage is covered.

18. The scroll compressor of claim 17, wherein the connection portion is inclined or curved with respect to the axial direction.

19. The scroll compressor of claim 16, wherein the suction guide passage overlaps in a circumferential direction at least a portion of the refrigerant suction pipe when viewed in the axial direction.

* * * * *